US007065843B1

(12) United States Patent
Wu

(10) Patent No.: US 7,065,843 B1
(45) Date of Patent: Jun. 27, 2006

(54) SAFETY BELT LATCH FOR CAR

(76) Inventor: Wen-Yuan Wu, 10, Alley 1, Lane 746, Taiping Rd., Pu Hsin Hsiang, Changhua Hsien (TW)

( * ) Notice: Subject to any disclaimer, the term of this patent is extended or adjusted under 35 U.S.C. 154(b) by 0 days.

(21) Appl. No.: 11/119,544

(22) Filed: May 2, 2005

(51) Int. Cl.
*A44B 11/25* (2006.01)

(52) U.S. Cl. ..... 24/642; 24/205.17; 24/632; 24/631

(58) Field of Classification Search ..... 24/642, 24/631, 632, 579.1, 639, DIG. 35, DIG. 36, 24/574; 297/464, 468
See application file for complete search history.

(56) References Cited

U.S. PATENT DOCUMENTS 3,617,019 A * 11/1971 Femia ..... 244/151 A
3,747,167 A * 7/1973 Pravaz ..... 24/573.11
4,610,058 A * 9/1986 Stemmildt et al. ..... 24/579.11
4,813,111 A * 3/1989 Nohren ..... 24/632

* cited by examiner

*Primary Examiner*—Robert J. Sandy
*Assistant Examiner*—Marcus Menezes
(74) *Attorney, Agent, or Firm*—Alan D. Kamrath; Nikolai & Mersereau, P.A.

(57) ABSTRACT

A safety belt latch for a car includes a base, a cover, and a rotation member. Thus, the flattened opening of the connecting plate is spaced from the fixed post so that the fixed post is fixed independently and is not moved with the connecting plate, and the fixed snap of the safety belt is secured to the base of the safety belt latch by the fixed post of the cover rigidly and stably, thereby preventing the fixed snap of the safety belt from detaching from the safety belt latch.

15 Claims, 9 Drawing Sheets

SAFETY BELT LATCH FOR CAR

BACKGROUND OF THE INVENTION

1. Field of the Invention

The present invention relates to a safety belt latch, and more particularly to a safety belt latch for a car.

2. Description of the Related Art

A conventional safety belt latch for a safety belt 99 of a car in accordance with the prior art shown in FIGS. 10–12 comprises a support seat 17, a locking plate 18 secured to the support seat 17, a cover body 11 secured on the support seat 17 and having a top formed with a limit block 111 (see FIG. 12), a plurality of locking screws 19 extended through the locking plate 18 and the support seat 17 and screwed into the cover body 11, a fixing disk 16 secured on a bottom of the cover body 11, a fixed post 112 mounted in the cover body 11, at least one movable post 113 movably mounted in the cover body 11, a connecting plate 13 movably mounted in the cover body 11 and having a central hole 130 formed with two retaining grooves 131 and having a periphery formed with a plurality of clamping openings 132 clamped on the fixed post 112 and the movable post 113 to move the fixed post 112 and the movable post 113, a circular plate 14 secured on the connecting plate 13 and having a first side formed with two retaining bosses 141 retained in the retaining grooves 131 of the connecting plate 13 and a second side formed with a notch 140, a rotation shaft 15 rotatably mounted in the cover body 11 and having a first end provided with a pin 152 rested on the notch 140 of the circular plate 14 and a second end 151 protruding outward from the cover body 11 and formed with a screw bore 153 (see FIG. 12), an elastic member 12 mounted on the rotation shaft 15 and biased between the cover body 11 and the connecting plate 13 to push the connecting plate 13 toward the support seat 17, a rotation handle 10 secured on the second end 151 of the rotation shaft 15 to rotate the rotation shaft 15 and having a center formed with a through hole 102, a positioning plate 101 fixed on the rotation handle 10 to rotate therewith and having a center formed with a fixing hole 1012 secured on the second end 151 of the rotation shaft 15 and a periphery formed with an arcuate limit slot 1011 mounted on the limit block 111 of the cover body 11, and a fixing screw 1530 extended through the through hole 102 of the rotation handle 10 and the fixing hole 1012 of the positioning plate 101 and screwed into the screw bore 153 of the rotation shaft 1534 to fix the rotation handle 10 on the rotation shaft 15. The safety belt 99 has a fixed snap 990 inserted into the support seat 17 and fixed by the fixed post 112 as shown in FIG. 12.

However, the positioning plate 101 has a greater thickness and a heavier weight, thereby greatly increasing costs of fabrication. In addition, the connecting plate 13 is separated from the circular plate 14, thereby causing inconvenience in assembly of the safety belt latch.

SUMMARY OF THE INVENTION

In accordance with the present invention, there is provided a safety belt latch, comprising a base, a cover, and a rotation member, wherein:

the base includes a support seat having a first side formed with an oblique semi-circular rib with a height differential and a second side formed with a plurality of channels for mounting a plurality of elastic units;

each of the channels of the support seat is formed with an elongated slideway;

each of the elastic units of the base includes a rod secured in the respective channel of the support seat, a slide slidably mounted on the rod and having a protruding stop slidably mounted in the slideway of the respective channel, and a spring mounted on the rod and biased between of the support seat and the slide to push the slide outward relative to the support seat;

the cover includes a cover body secured on the support seat of the base, a fixed post mounted in the cover body and having a first end stopped by the stop of a respective elastic unit of the base, at least one movable post movably mounted in the cover body and having a first end stopped by the stop of a respective elastic unit of the base, a connecting plate movably mounted in the cover body and engaged with the movable post to move the movable post, a rotation shaft rotatably mounted in the cover body and having a first end provided with a pin rested on the semi-circular rib of the support seat and the connecting plate and a second end protruding outward from the cover body;

the rotation member includes a rotation handle secured on the second end of the rotation shaft to rotate the rotation shaft.

The primary objective of the present invention is to provide a safety belt latch, wherein the flattened opening of the connecting plate is spaced from the fixed post so that the fixed post is fixed independently and is not moved with the connecting plate, and the fixed snap of the safety belt is secured to the base of the safety belt latch by the fixed post of the cover rigidly and stably, thereby preventing the fixed snap of the safety belt from detaching from the safety belt latch.

Another objective of the present invention is to provide a safety belt latch, wherein the connecting plate is integrally formed with the notch, so that the safety belt latch has a simplified construction, thereby decreasing costs of fabrication.

A further objective of the present invention is to provide a safety belt latch, wherein the safety belt latch is assembly easily and conveniently.

A further objective of the present invention is to provide a safety belt latch, wherein the safety belt latch has a lighter weight.

Further benefits and advantages of the present invention will become apparent after a careful reading of the detailed description with appropriate reference to the accompanying drawings.

DETAILED DESCRIPTION OF THE INVENTION

Figure 1:
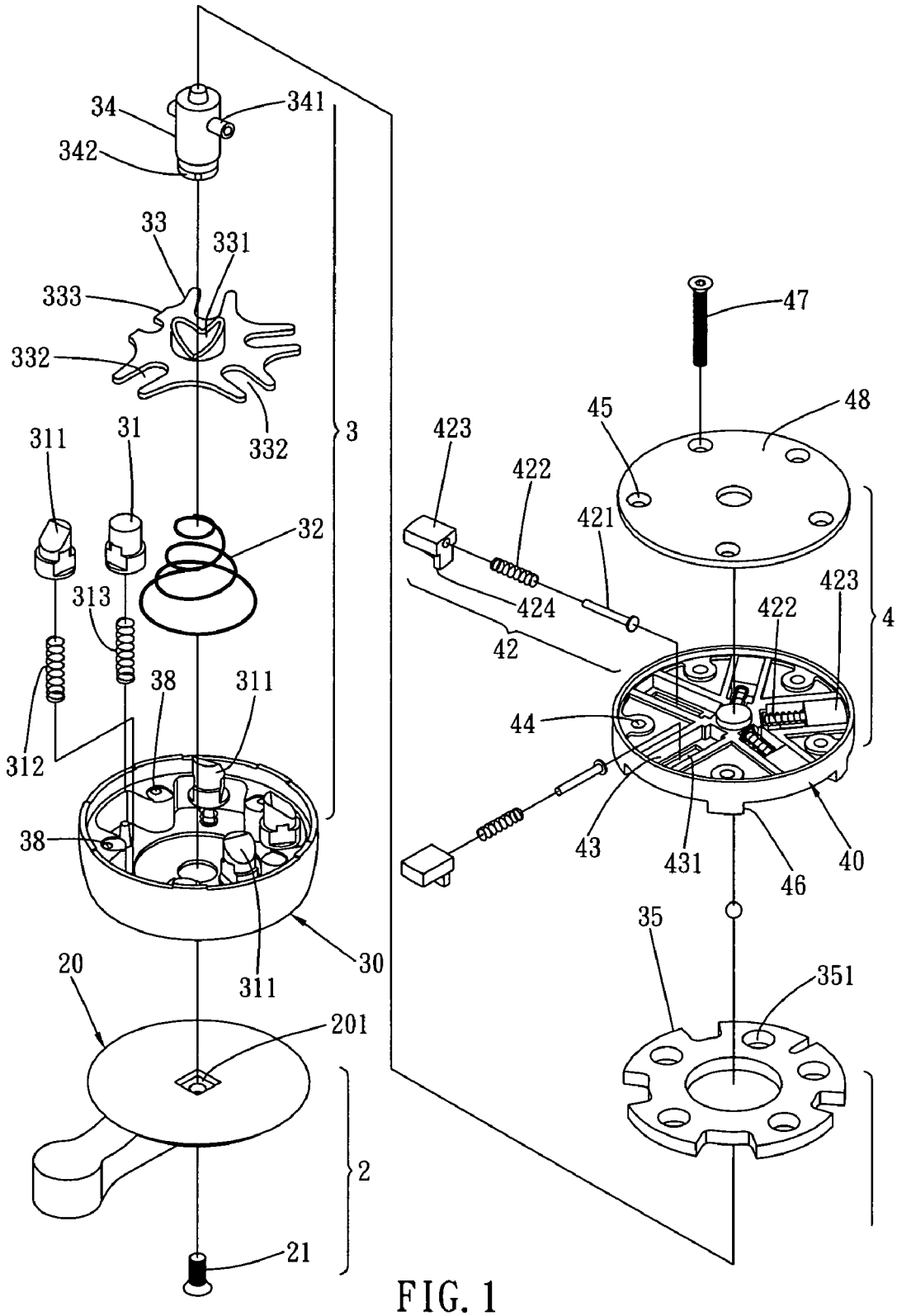
FIG. 1 is an exploded perspective view of a safety belt latch in accordance with the preferred embodiment of the present invention.
Figure 2:
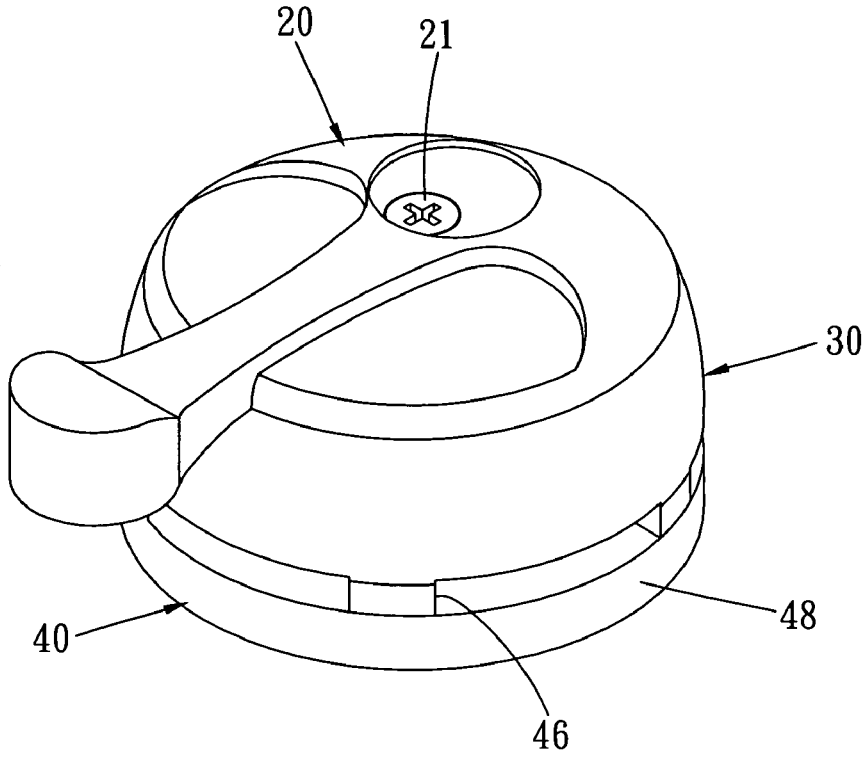
FIG. 2 is a perspective assembly view of the safety belt latch as shown in FIG. 1.
Figure 3:
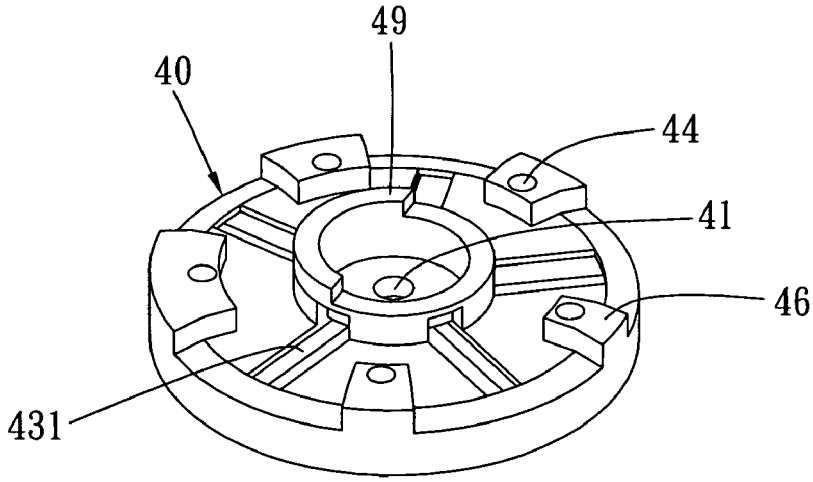
FIG. 3 is a perspective view of a support seat of the safety belt latch as shown in FIG. 1.

Referring to the drawings and initially to FIGS. 1–5, a safety belt latch for a safety belt 5 of a car in accordance with the preferred embodiment of the present invention comprises a base 4, a cover 3, and a rotation member 2.

The base 4 includes a support seat 40 having a first side formed with an oblique semi-circular rib 49 with a height differential and a second side formed with a plurality of channels 43 for mounting a plurality of elastic units 42, and a locking plate 48 secured to the support seat 40 by a plurality of locking screws 47. The support seat 40 has a plurality of mounting holes 44 to allow passage of the locking screws 47. The first side of the support seat 40 has a center formed with a circular hole 41 and a periphery formed with a plurality of studs 46. Each of the channels 43 of the support seat 40 is formed with an elongated slideway 431. The locking plate 48 has a plurality of through holes 45 to allow passage of the locking screws 47. Each of the elastic units 42 of the base 4 includes a rod 421 secured in the respective channel 43 of the support seat 40, a slide 423 slidably mounted on the rod 421 and having a protruding stop 424 slidably mounted in the slideway 431 of the respective channel 43, and a spring 422 mounted on the rod 421 and biased between of the support seat 40 and the slide 423 to push the slide 423 outward relative to the support seat 40.

The cover 3 includes a cover body 30 secured on the support seat 40 of the base 4 and having a plurality of screw bores 38 screwed onto the locking screws 47, a fixed post 31 mounted in the cover body 30 and having a first end stopped by the stop 424 of a respective elastic unit 42 of the base 4, a first push spring 313 biased between a second end of the fixed post 31 and the cover body 30 to push the fixed post 31 toward the support seat 40 of the base 4, at least one movable post 311 movably mounted in the cover body 30 and having a first end stopped by the stop 424 of a respective elastic unit 42 of the base 4, at least one second push spring 312 biased between a second end of the movable post 311 and the cover body 30 to push the movable post 311 toward the support seat 40 of the base 4, a fixing disk 35 secured on a bottom of the cover body 30 and having a plurality of through holes 351 to allow passage of the fixed post 31 and the movable post 311, a connecting plate 33 movably mounted in the cover body 30 and engaged with the movable post 311 to move the movable post 311, a rotation shaft 34 rotatably mounted in the cover body 30 and having a first end provided with a pin 341 rested on the semi-circular rib 49 of the support seat 40 and the connecting plate 33 and a second end 342 protruding outward from the cover body 30 and formed with a screw bore 343 (see FIG. 4), and an elastic member 32 mounted on the rotation shaft 34 and biased between the cover body 30 and the connecting plate 33 to push the connecting plate 33 toward the support seat 40.

When the rotation shaft 34 is rotated, the pin 341 of the rotation shaft 34 is moved on the semi-circular rib 49 of the support seat 40 to push the connecting plate 33 toward the cover body 30 to drive the movable post 311 to move toward the cover body 30. The pin 341 of the rotation shaft 34 has an asymmetrical length.

The connecting plate 33 has a center integrally formed with a notch 331 rested on the pin 341 of the rotation shaft 34 and has a periphery formed with a flattened opening 333 spaced from the fixed post 31 and at least one clamping opening 332 clamped on the movable post 311 so that the movable post 311 is movable with the connecting plate 33.

The rotation member 2 includes a rotation handle 20 secured on the second end 342 of the rotation shaft 34 to rotate the rotation shaft 34, and a fixing screw 21 extended through the rotation handle 20 and screwed into the screw bore 343 of the rotation shaft 34 to fix the rotation handle 20 on the rotation shaft 34. The rotation handle 20 has a mounting hole 201 mounted on the second end 342 of the rotation shaft 34.

The safety belt 5 includes a fixing cord 53, a fixed snap 52 mounted on a fixed end of the fixing cord 53, and a movable snap 51 (see FIG. 8) mounted on a movable end of the fixing cord 53.

Figure 4:
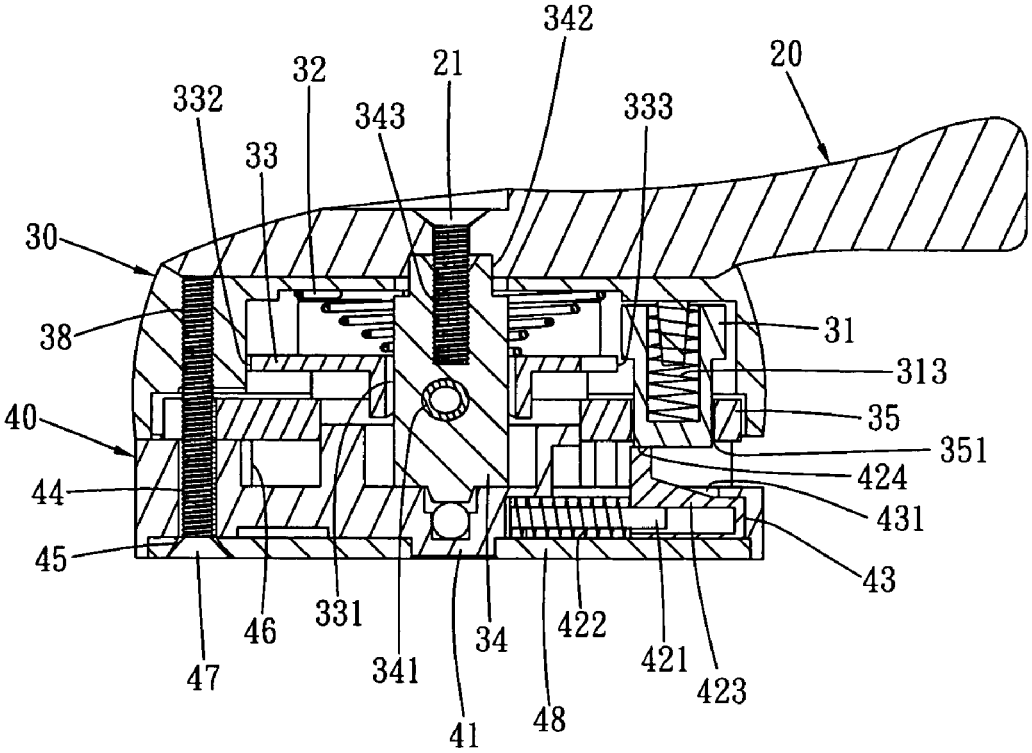
FIG. 4 is a plan cross-sectional view of the safety belt latch as shown in FIG. 2.
Figure 5:
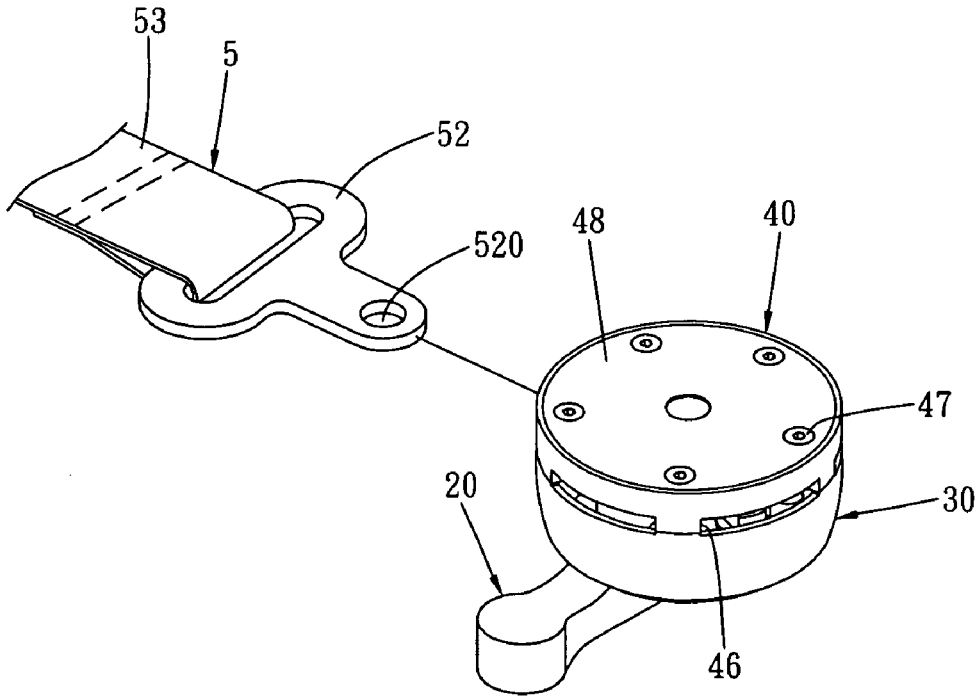
FIG. 5 is a perspective assembly view of the safety belt latch as shown in FIG. 1.
Figure 6:
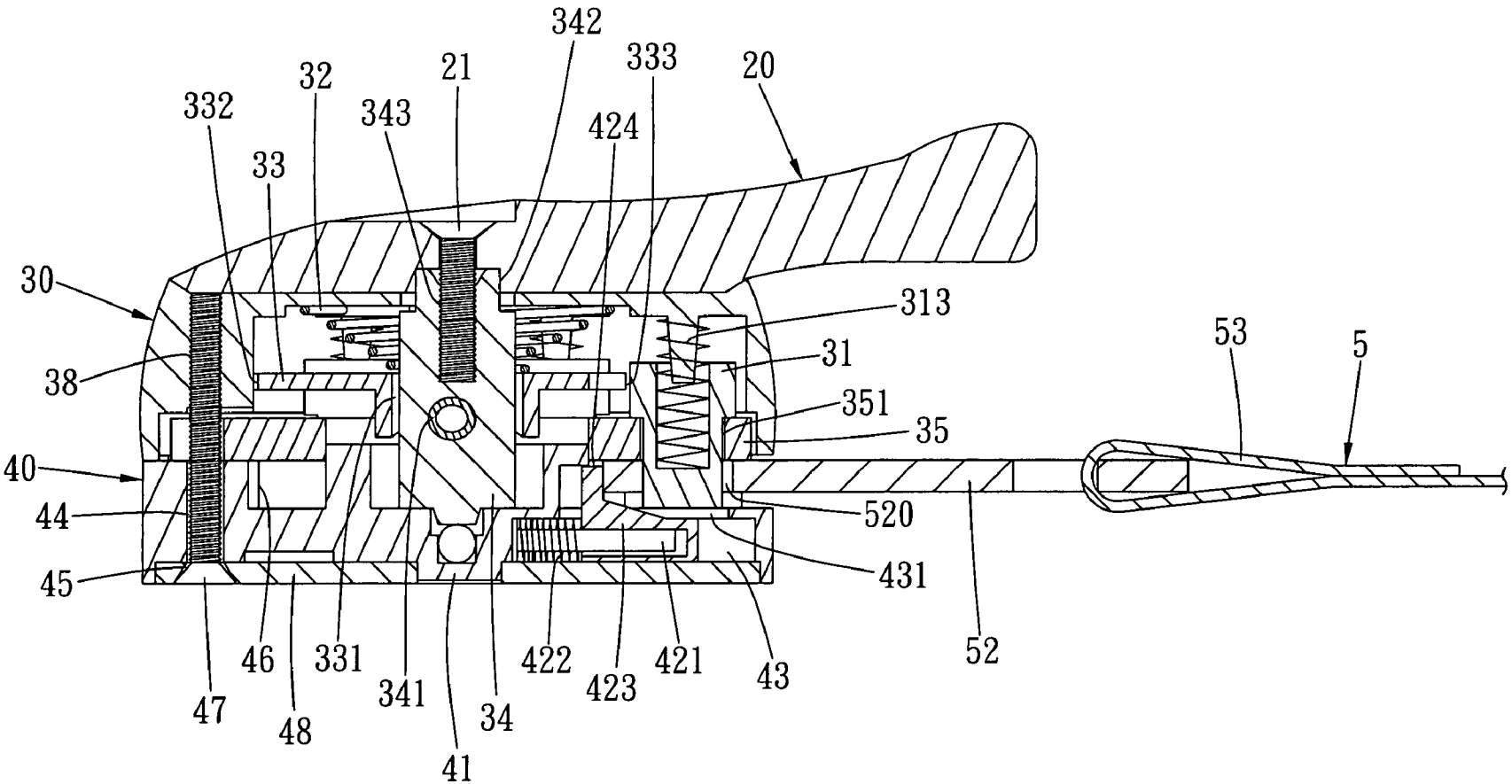
FIG. 6 is a schematic operational view of the safety belt latch as shown in FIG. 4.

Referring to FIGS. 1–6, the fixed post 31 of the cover 3 is initially stopped by the stop 424 of a respective elastic unit 42 of the base 4 as shown in FIG. 4. When the fixed snap 52 of the safety belt 5 is inserted into the support seat 40 of the base 4, the slide 423 of the respective elastic unit 42 is pushed inward by the fixed snap 52 of the safety belt 5 to release the fixed post 31 of the cover 3 from the stop 424 so that the fixed post 31 of the cover 3 is pushed by the first push spring 313 and is inserted into a snapping hole 520 of the fixed snap 52 of the safety belt 5 as shown in FIG. 5, so that the fixed snap 52 of the safety belt 5 is secured to the base 4 of the safety belt latch by the fixed post 31 of the cover 3.

Similarly, the movable post 311 is initially stopped by the stop 424 of a respective elastic unit 42 of the base 4. When the movable snap 51 of the safety belt 5 is inserted into the support seat 40 of the base 4, the slide 423 of the respective elastic unit 42 is pushed inward by the movable snap 51 of the safety belt 5 to release the movable post 311 of the cover 3 from the stop 424 so that the movable post 311 of the cover 3 is pushed by the second push spring 312 and is inserted into a snapping hole 510 of the movable snap 51 of the safety belt 5 as shown in FIG. 8, so that the movable snap 51 of the safety belt 5 is secured to the base 4 of the safety belt latch by the movable post 311 of the cover 3.

Figure 7:
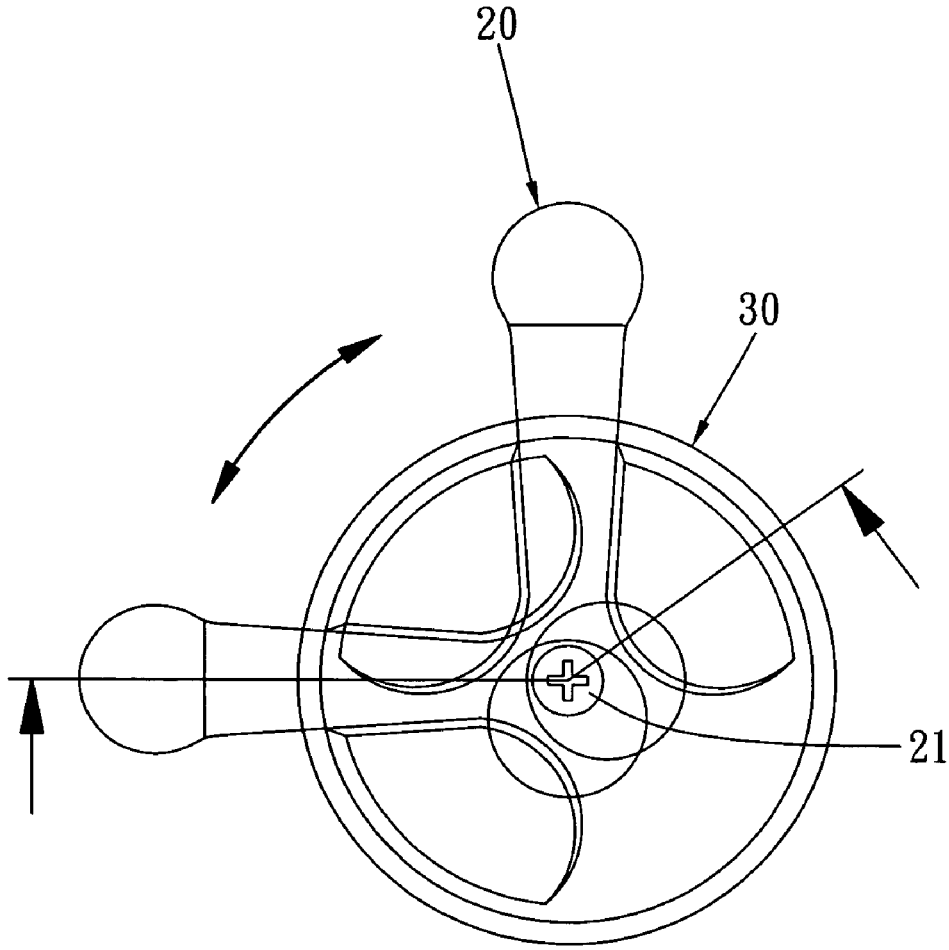
FIG. 7 is a schematic plan operational view of the safety belt latch as shown in FIG. 2.
Figure 8:
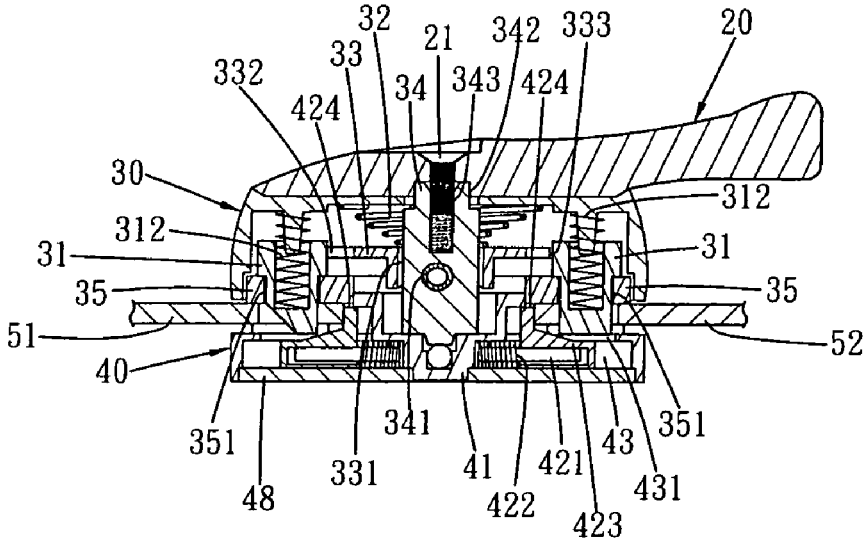
FIG. 8 is a plan cross-sectional view of the safety belt latch as shown in FIG. 7.
Figure 9:
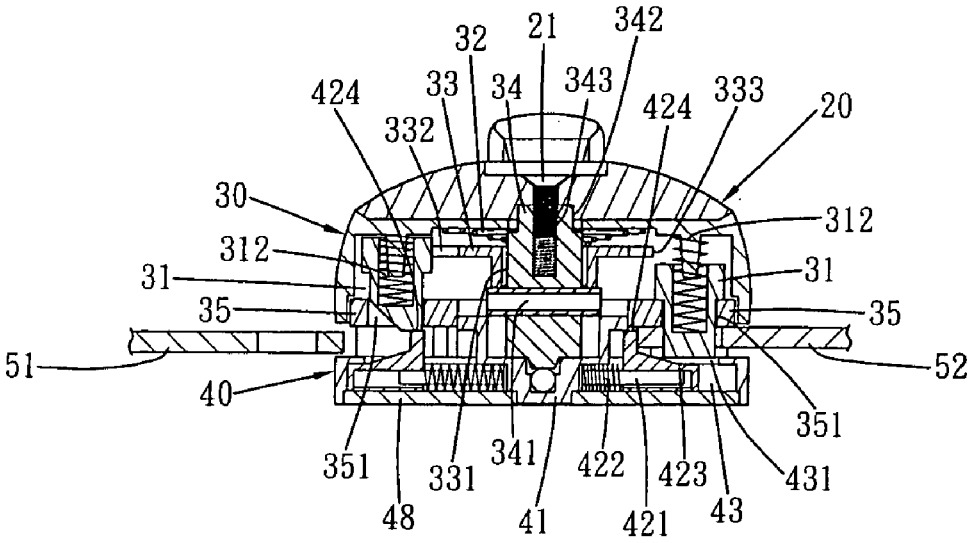
FIG. 9 is a schematic operational view of the safety belt latch as shown in FIG. 8.
Figure 10:
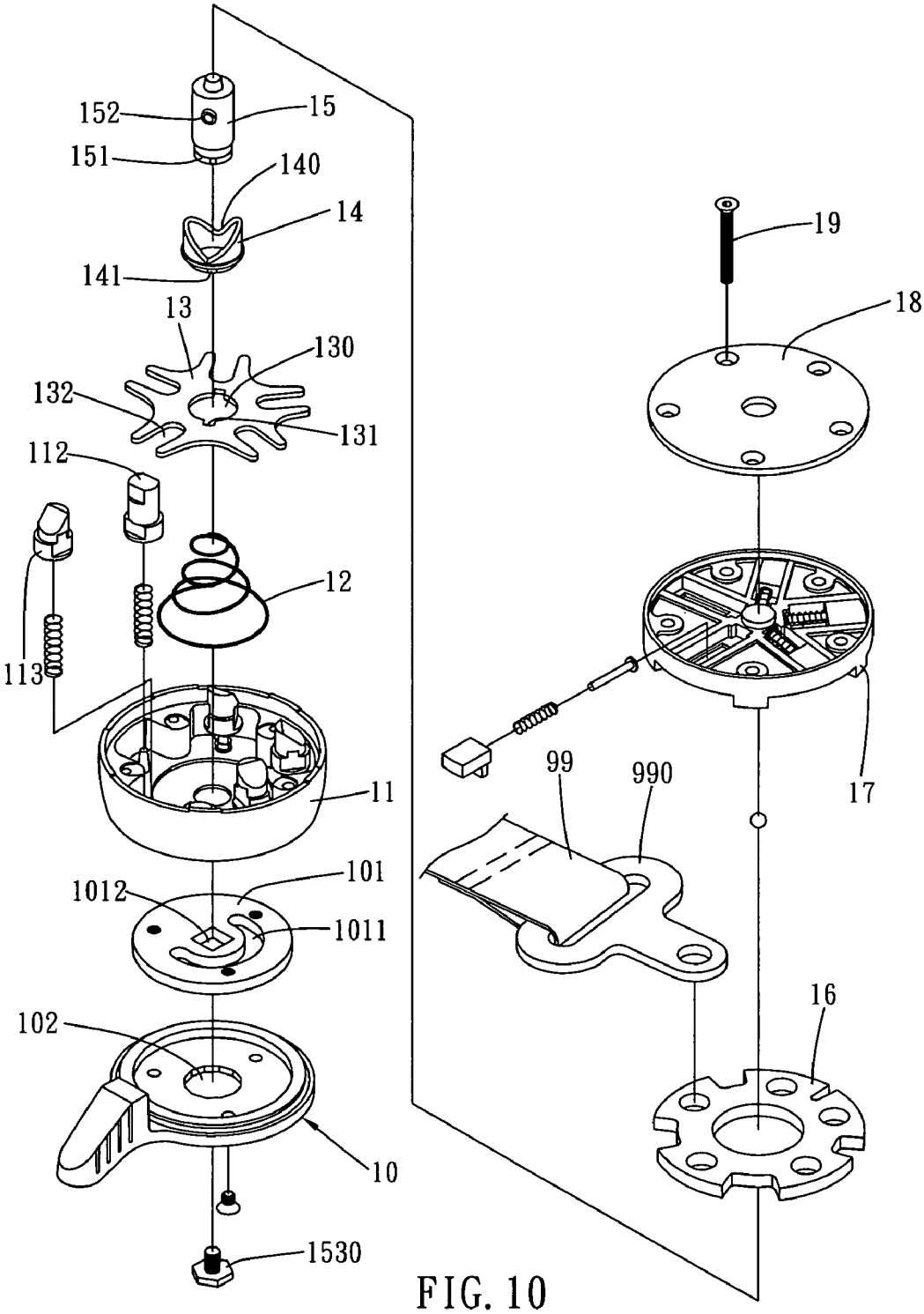
FIG. 10 PRIOR ART
FIG. 10 is an exploded perspective view of a conventional safety belt latch in accordance with the prior art.
Figure 11:
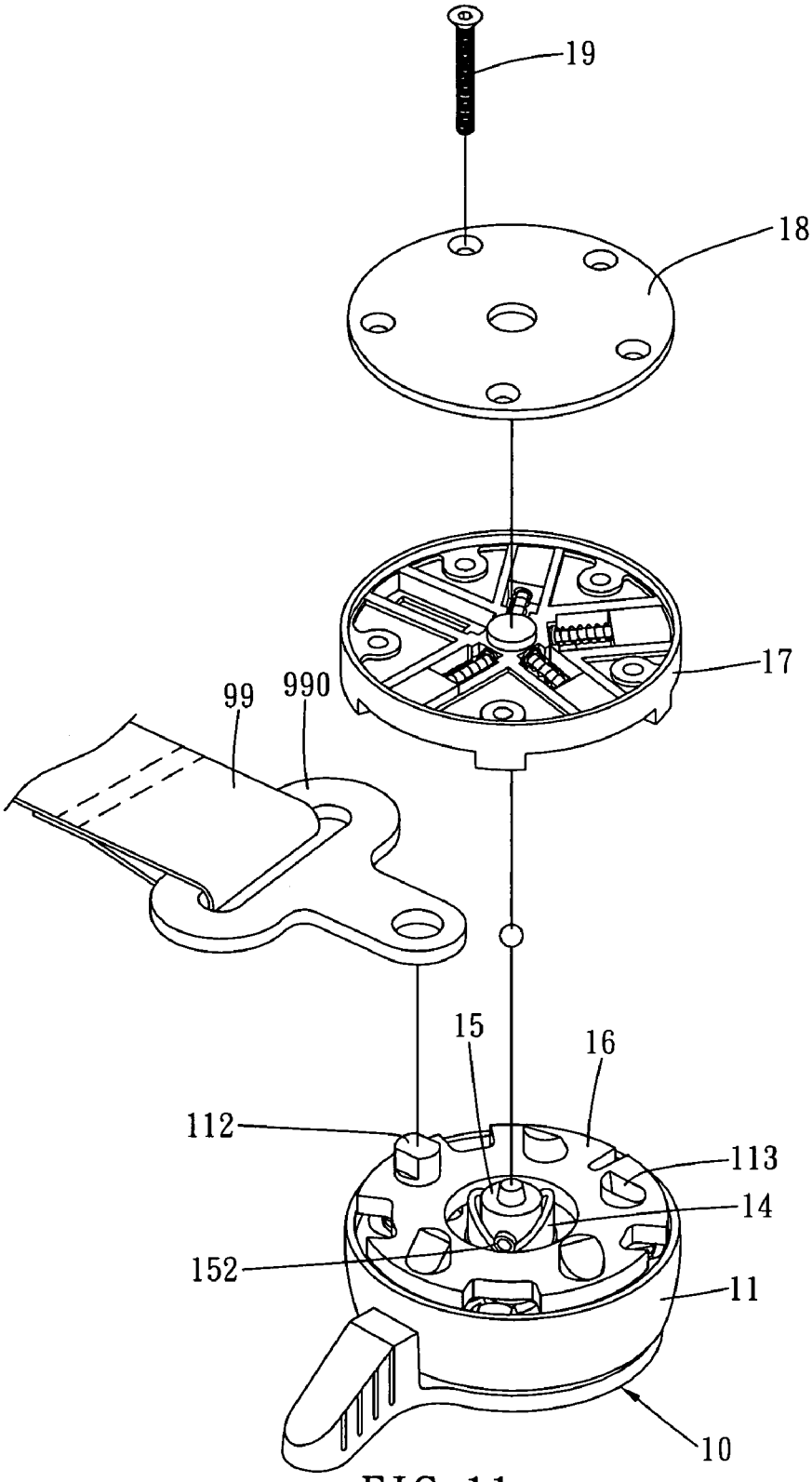
FIG. 11 PRIOR ART
FIG. 11 is a partially perspective assembly view of the conventional safety belt latch as shown in FIG. 10.
Figure 12:
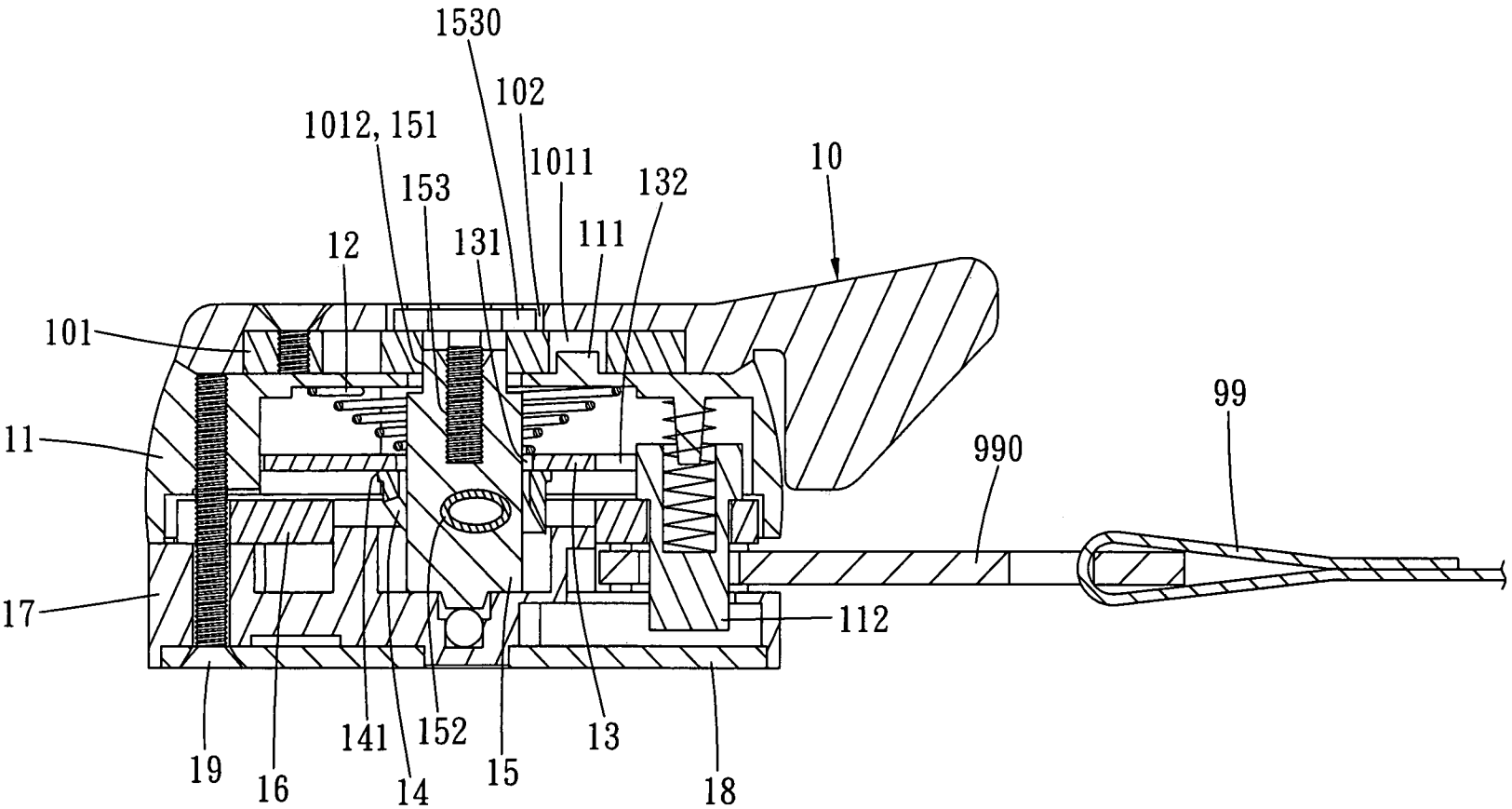
FIG. 12 PRIOR ART
FIG. 12 is a plan cross-sectional assembly view of the conventional safety belt latch as shown in FIG. 10.

Referring to FIGS. 7–9 with reference to FIGS. 1–6, when the rotation shaft 34 is rotated by the rotation handle 20 of the rotation member 2, the pin 341 of the rotation shaft 34 is moved on the oblique semi-circular rib 49 of the support seat 40 to push the connecting plate 33 toward the cover body 30 to drive the movable post 311 to move toward the cover body 30 so as to release the movable snap 51 of the safety belt 5 from the movable post 311, so that the movable snap 51 of the safety belt 5 is pushed outward by the restoring force of the spring 422 of the respective elastic unit 42, thereby detaching the movable snap 51 of the safety belt 5 from the base 4 of the safety belt latch as shown in FIG. 9. At this time, the flattened opening 333 of the connecting plate 33 is spaced from the fixed post 31 so that the fixed post 31 is fixed and is not moved with the connecting plate 33, and the fixed snap 52 of the safety belt 5 is secured to the base 4 of the safety belt latch by the fixed post 31 of the cover 3 without detachment.

Accordingly, the flattened opening 333 of the connecting plate 33 is spaced from the fixed post 31 so that the fixed post 31 is fixed independently and is not moved with the connecting plate 33, and the fixed snap 52 of the safety belt 5 is secured to the base 4 of the safety belt latch by the fixed post 31 of the cover 3 rigidly and stably, thereby preventing the fixed snap 52 of the safety belt 5 from detaching from the safety belt latch. In addition, the connecting plate 33 is integrally formed with the notch 331, so that the safety belt latch has a simplified construction, thereby decreasing costs of fabrication. Further, the safety belt latch is assembly easily and conveniently. Further, the safety belt latch has a lighter weight.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A safety belt latch, comprising a base, a cover, and a rotation member, wherein:

the base includes a support seat having a first side formed with an oblique semi-circular rib with a height differential and a second side formed with a plurality of channels for mounting a plurality of elastic units;

each of the channels of the support seat is formed with an elongated slideway;

each of the elastic units of the base includes a rod secured in the respective channel of the support seat, a slide slidably mounted on the rod and having a protruding stop slidably mounted in the slideway of the respective channel, and a spring mounted on the rod and biased between of the support seat and the slide to push the slide outward relative to the support seat;

the cover includes a cover body secured on the support seat of the base, a fixed post mounted in the cover body and having a first end stopped by the stop of a respective elastic unit of the base, at least one movable post movably mounted in the cover body and having a first end stopped by the stop of a respective elastic unit of the base, a connecting plate movably mounted in the cover body and engaged with the movable post to move the movable post, a rotation shaft rotatably mounted in the cover body and having a first end provided with a pin rested on the connecting plate and a second end protruding outward from the cover body;

the slide of each of the elastic units is movable relative to the fixed post and the at least one movable post to release the fixed post from the stop of the respective elastic unit and to release the at least one movable post from the stop of the respective elastic unit;

the rotation member includes a rotation handle secured on the second end of the rotation shaft to rotate the rotation shaft;

the connecting plate has a periphery formed with a flattened opening spaced from the fixed post;

the fixed post is fixed independently and is not moved with the connecting plate.

2. The safety belt latch in accordance with claim 1, wherein the pin of the rotation shaft is moved on the semi-circular rib of the support seat by rotation of the rotation shaft to push the connecting plate toward the cover body to drive the movable post to move toward the cover body.

3. The safety belt latch in accordance with claim 1, wherein the pin of the rotation shaft has an asymmetrical length.

4. The safety belt latch in accordance with claim 1, wherein the connecting plate has a center integrally formed with a notch rested on the pin of the rotation shaft.

5. The safety belt latch in accordance with claim 1, wherein the connecting plate has a periphery formed with at least one clamping opening clamped on the movable post so that the movable post is movable with the connecting plate.

6. The safety belt latch in accordance with claim 1, wherein the rotation handle has a mounting hole mounted on the second end of the rotation shaft.

7. The safety belt latch in accordance with claim 1, wherein the second end of the rotation shaft is formed with a screw bore, and the rotation member further includes a fixing screw extended through the rotation handle and screwed into the screw bore of the rotation shaft to fix the rotation handle on the rotation shaft.

8. The safety belt latch in accordance with claim 1, wherein the base further includes a locking plate secured to the support seat by a plurality of locking screws and having a plurality of through holes to allow passage of the locking screws.

9. The safety belt latch in accordance with claim 8, wherein the support seat has a plurality of mounting holes to allow passage of the locking screws.

10. The safety belt latch in accordance with claim 8, wherein the cover body has a plurality of screw bores screwed onto the locking screws.

11. The safety belt latch in accordance with claim 1, wherein the first side of the support seat has a center formed with a circular hole and a periphery formed with a plurality of studs.

12. The safety belt latch in accordance with claim 1, wherein the cover further includes a push spring biased between a second end of the fixed post and the cover body to push the fixed post toward the support seat of the base.

13. The safety belt latch in accordance with claim 1, wherein the cover further includes at least one push spring biased between a second end of the movable post and the cover body to push the movable post toward the support seat of the base.

14. The safety belt latch in accordance with claim 1, wherein the cover further includes a fixing disk secured on a bottom of the cover body and having a plurality of through holes to allow passage of the fixed post and the movable post.

15. The safety belt latch in accordance with claim 1, wherein the cover further includes an elastic member mounted on the rotation shaft and biased between the cover body and the connecting plate to push the connecting plate toward the support seat.

* * * * *